United States Patent [19]

Bruckner

[11] 4,262,590

[45] Apr. 21, 1981

[54] AUXILIARY PRINTING UNIT FOR A PRINTING PRESS, IN PARTICULAR A ROTARY PRINTING PRESS

[75] Inventor: Carl-Heinz Bruckner, Bensheim-Auerbach, Fed. Rep. of Germany

[73] Assignee: M.A.N.-Roland Druckmaschinen Aktiengesellschaft, Fed. Rep. of Germany

[21] Appl. No.: 115,876

[22] Filed: Jan. 28, 1980

Related U.S. Application Data

[63] Continuation-in-part of Ser. No. 103,767, Dec. 14, 1979.

[30] Foreign Application Priority Data

Dec. 14, 1978 [DE] Fed. Rep. of Germany ..... 2853901

[51] Int. Cl.[3] ..... B41F 13/14; B41F 13/20; B41F 13/28

[52] U.S. Cl. ..... 101/76; 101/144; 101/216; 101/248

[58] Field of Search ..... 101/132, 136, 137, 138, 101/139, 140, 76, 77, 152, 153, 154, 174, 177, 178, 179–182, 183, 212, 216, 219, 247, 142, 143, 144, 145, 248

[56] References Cited

U.S. PATENT DOCUMENTS

| | | | |
|---|---|---|---|
| 2,216,562 | 10/1940 | Barber | 101/220 |
| 3,728,960 | 4/1973 | Heath | 101/76 |
| 3,783,780 | 1/1974 | Saueressig | 101/153 |
| 4,024,812 | 5/1977 | Jahn | 101/76 |

FOREIGN PATENT DOCUMENTS

| | | | |
|---|---|---|---|
| 2223686 | 11/1972 | Fed. Rep. of Germany | 101/174 |

*Primary Examiner*—J. Reed Fisher

*Attorney, Agent, or Firm*—Leydig, Voit, Osann, Mayer & Holt, Ltd.

[57] ABSTRACT

An auxiliary printing unit assembly including an auxiliary press unit dimensioned to fit between the frame members of a press main frame. Stops on the main frame define a working position adjacent the press impression cylinder. A coupling assembly is journaled in the press main frame for interconnecting the press drive and the shaft of the press unit. The coupling assembly has an internally splined hollow drive shaft and an externally splined mandrel slidable in the drive shaft between inwardly extended and retracted positions. The mandrel has an expandible hub at its inner end dimensioned to mate with a recess in the press unit shaft when the mandrel is inwardly extended. The mandrel and press unit shaft have respective off-center registering elements which are also axially engaged when the mandrel is inwardly extended. Register indicia on the mandrel and the press unit shaft are so positioned that upon alignment thereof the registering elements are aligned with one another in readiness for axial engagement. A manually rotated transversely arranged operating shaft in the mandrel carries cams for sequentially (a) shifting the mandrel from its retracted position to its extended position and for (b) expanding the hub to insure a tight centered driving connection with the press unit shaft.

14 Claims, 11 Drawing Figures

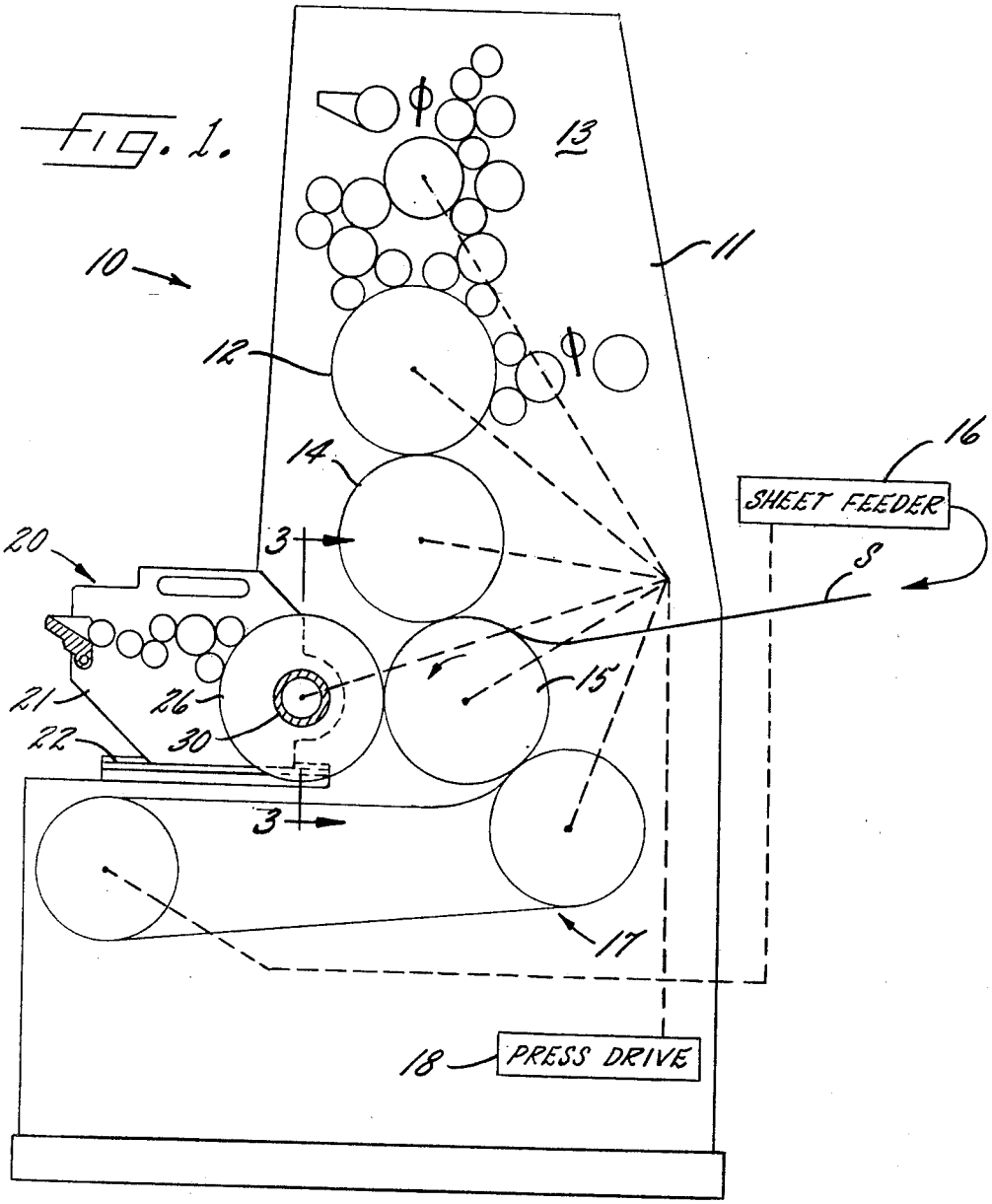
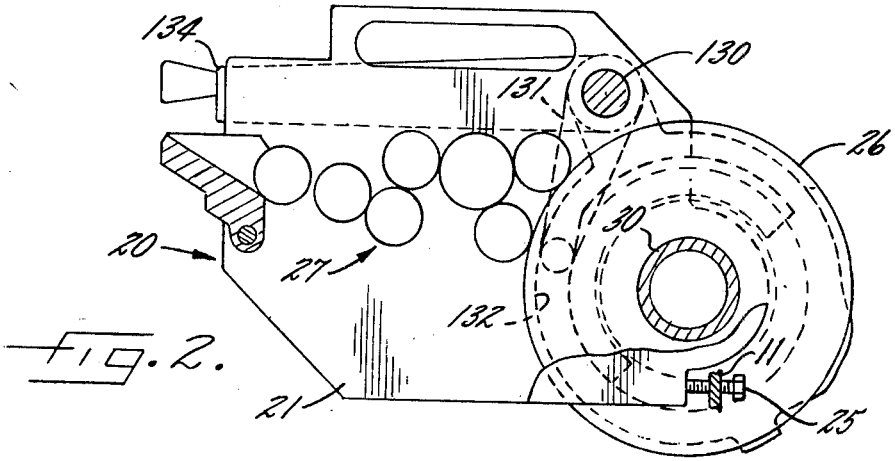
Fig. 2.

AUXILIARY PRINTING UNIT FOR A PRINTING PRESS, IN PARTICULAR A ROTARY PRINTING PRESS

This is a continuation-in-part of my earlier filed pending application entitled Auxiliary Printing Unit For A Printing Press, In Particular A Rotary Printing Press, Ser. No. 103,767 filed Dec. 14, 1979.

It is known to provide an auxiliary printing unit which is portable and which may be installed on a printing press in a position adjacent the impression cylinder for making a special printed impression upon the product. Auxiliary printing units most often take the form of "numbering boxes" for printing a number on the product. With the addition of an automatic stepping mechanism it is possible to number the printed impressions consecutively.

U.S. Pat. No. 4,024,812 which issued May 24, 1977 describes an auxiliary numbering unit for a sheet-fed offset press in which the numbering unit and its inking arrangement are separately constructed and must be separately installed and removed, which requires additional set-up time. Moreover, the coupling assembly which drives the auxiliary mechanism occupies considerable space within the press main frame so that the full width between the frame members is not available for the auxiliary unit.

Auxiliary printing units of unitary construction are also known as shown by German Auslegeschrift No. 22 23 686 which was published Nov. 30, 1972. Such unit really falls into a different category from the present since it is inherently much larger in size and requires a truck to install and remove; nor does the unit possess those features and advantages which distinguish the present construction.

It is, accordingly, an object of the invention to provide an auxiliary printing unit which can be quickly mounted on, and removed from, an associated printing press as a complete, compact and lightweight unit. It is an object to provide, as part of the associated press, a novel coupling assembly which is journaled in the press main frame and which is readily brought into registered driving engagement with the press unit shaft. More specifically it is an object of the invention to provide an auxiliary press unit which may be manually slid into a reference position within the press seated adjacent the press impression cylinder without interference between any driving or registering elements. Following a simple registering step all that is required is to manually rotate an operating shaft through a partial turn to complete a tight, centered drive connection between the press drive and the shaft of the printing unit.

It is a more specific object to provide a coupling assembly including a mandrel slidable in the press frame between a retracted position for insertion of the press unit into the press and an extended position in which the mandrel drivingly engages the press unit shaft. To provide prompt positive coupling between the two, the mandrel is provided with an expandible hub which engages a hollow at the end of the press unit shaft. Turning of the operating shaft results in automatic sequential motion of the mandrel to its extended position followed by the expansion of the hub into gripping engagement.

It is another object of the invention to provide a registered drive connection for an auxiliary printing unit including a drive shaft mounted in the press frame with an interposed eccentric sleeve to achieve throw-off and positional adjustment of the printing unit with respect to the impression cylinder with which it cooperates.

It is a further object of the invention to provide a coupling assembly of the above type which nevertheless occupies only a small amount of space, measured axially, within the press frame so that the printing unit may utilize substantially the full width between the side frames of the press.

It is yet another object to provide a coupling assembly for an auxiliary press unit which requires only a partial turn of a single operating shaft for coupling-up, with reversal of the movement for subsequent uncoupling, following which the unit may be easily removed, as a unit, from the main press.

Other objects and advantages of the invention will become apparent upon reading the attached detailed description and upon reference to the drawings in which:

FIG. 1 is a diagrammatic side elevation of a printing press utilizing an auxiliary printing unit in accordance with the present invention.

FIG. 2 is a diagrammatic elevation of the auxiliary printing unit of FIG. 1.

Figure 3:
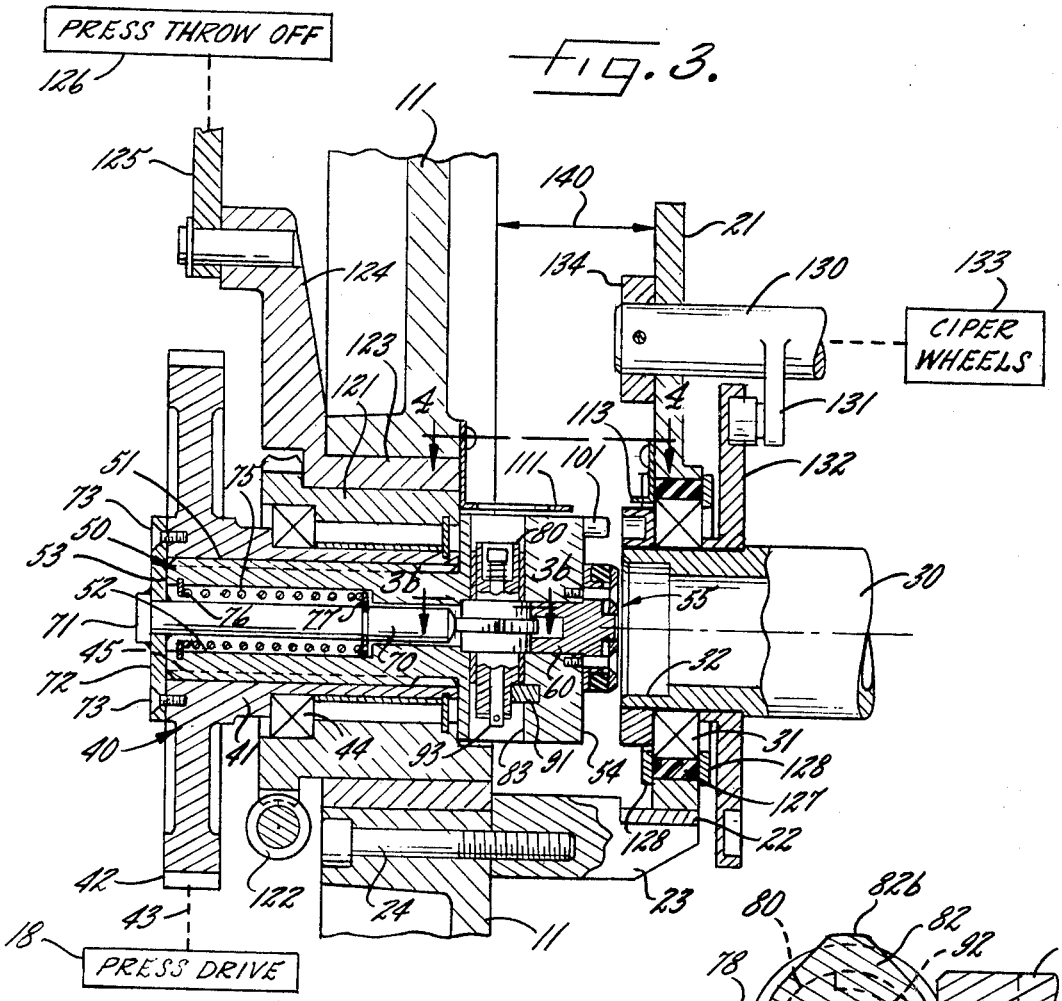
FIG. 3 is a fragmentary section taken along line 3—3 in FIG. 1 showing the means for coupling and driving the auxiliary printing unit, but with the coupling being in disengaged condition.
Figure 3B:
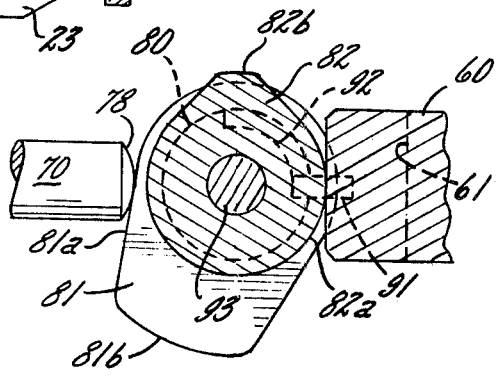
Figure 3A:
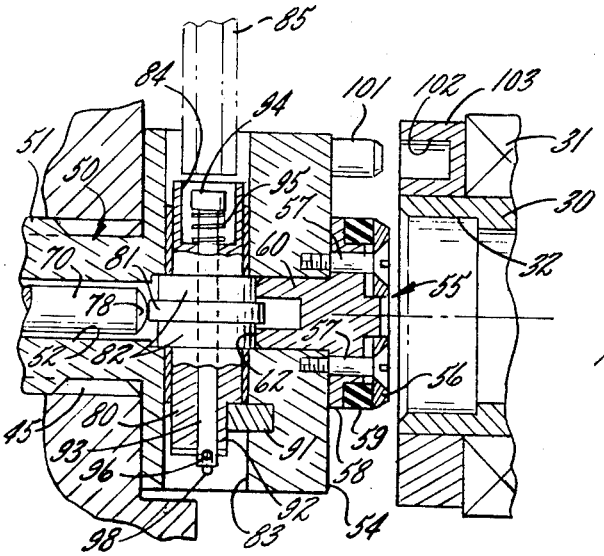

FIG. 3*a* is a fragmentary section based upon FIG. 3 but showing the coupling surfaces on a larger scale.

FIG. 3*b* is a fragmentary section showing the cam profiles as viewed along line 3*b*—3*b* in FIG. 3.

Figure 4:
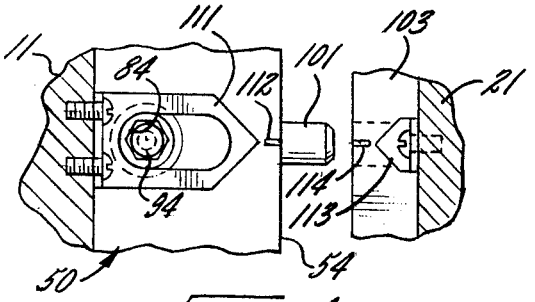

FIG. 4 shows the alignment pointers in condition for alignment prior to engaging the coupling as viewed along line 4—4 in FIG. 3.

Figure 5:
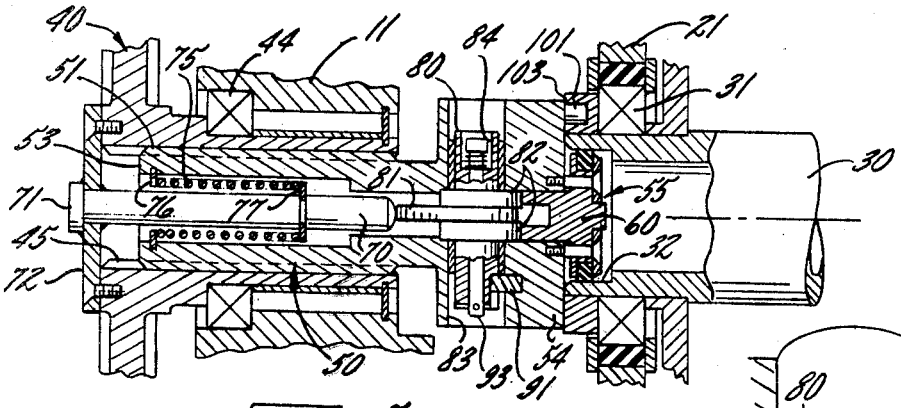

FIG. 5 is a view similar to FIG. 3 but showing the mechanism in engaged condition.

Figure 5A:
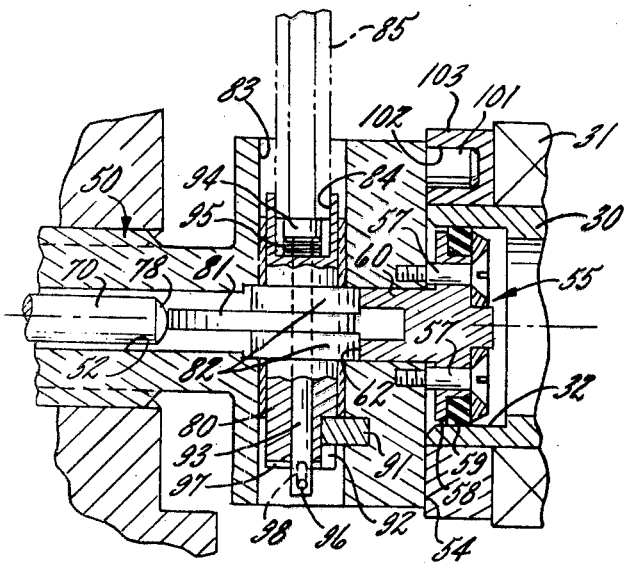

FIG. 5*a* is a view similar to FIG. 3*a* but showing the coupling surfaces engaged.

Figure 5B:
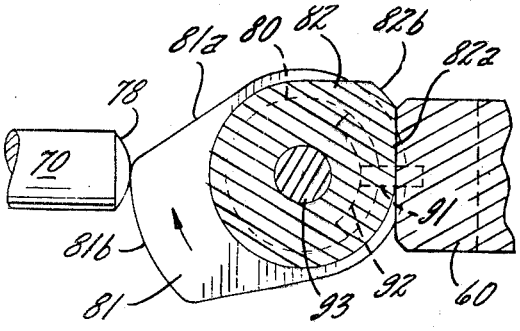
Figure 5C:
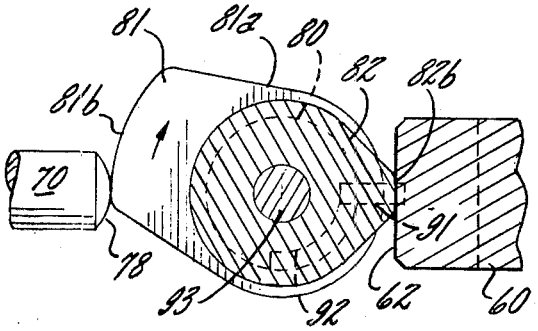

FIGS. 5*b* and 5*c* are a set of stop motion views showing, respectively, the transitional and final positions of the cam assembly.

Figure 6:
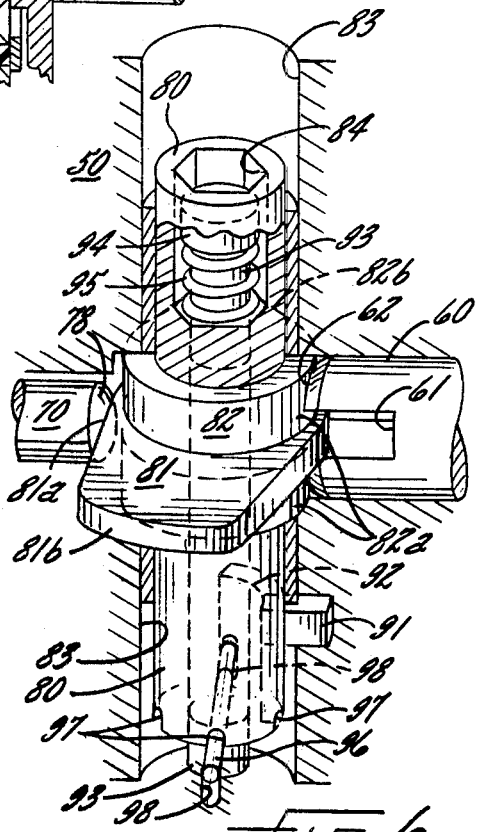

FIG. 6 is a perspective view of the operating shaft and cam assembly including the means for locking the shaft at the ends of its range of movement.

While the invention has been described in connection with a preferred embodiment, it will be understood that I do not intend to be limited to the particular embodiment shown but intend, on the contrary, to cover the various alternative and equivalent constructions included within the spirit and scope of the appended claims.

Turning now to the drawings there is disclosed in FIG. 1 a sheet-fed rotary printing press 10 of the lithographic type having a pair of vertical main frame members 11 spaced parallel to one another, as is conventional, (only one being shown). Journaled in the frame members are a set of cylinders including a plate cylinder 12, with the usual sources of ink and water 13, a blanket cylinder 14 and an impression cylinder 15. The press, being sheet-fed, includes a sheet feeder 16 for feeding a series of sheets S between the impression and blanket cylinders where printing occurs. Each sheet is then transferred to a conveyor 17 for transport from the machine. All rotating members of the press are synchronously driven from a common press drive 18, the drive connections being indicated by respective dotted lines.

The auxiliary press unit generally indicated at 20 has a frame which includes a pair of spaced vertical frame plates 21, only one of which is shown, which are supported on a seating surface adjacent the impression cylinder 15. The seating surface is in the form of a laterally spaced pair of rails 22 (only one of which is shown in FIG. 3), each of the rails being mounted upon a bracket 23 secured to the adjacent press frame 11 by a set of screws 24. A stop 25 (FIG. 2) mounted in the path of movement of the press unit along the rails 22 determines the operating position of the unit.

Mounted between the frame members of the auxiliary press unit is an auxiliary printing cylinder 26 which, in the event the device is used as a numbering machine, has a concentrated raised printing area. The printing area is inked by an ink feed system generally indicated at 27. For supporting the printing cylinder 26 a press unit shaft 30 is provided which is journaled in bearings 31 mounted in the respective frame plates 21. The shaft 30 is preferably of hollow construction so that the end of the shaft forms a hollow cylindrical recess 32.

In accordance with the present invention a novel coupling assembly is provided for interconnecting the press drive 18 and the press unit shaft 30. The coupling assembly comprises an internally splined hollow drive shaft coupled to the press drive and an externally splined mandrel slidable endwise in the drive shaft between inwardly extended and retracted positions, the mandrel having an expandible hub at its inner end dimensioned to mate with the recess in the press unit shaft to form a driving connection therewith when the mandrel is inwardly extended.

Turning to FIG. 3, the coupling assembly indicated at 40 includes a hollow drive shaft 41 having a gear 42 at its outer end, the gear being coupled by a suitable drive train 43 to the press drive 18. The drive shaft is supported by a bearing 44 with respect to the main press frame member 11 with interposed eccentric sleeves to which reference will later be made. The drive shaft is machined with a longitudinally extending set of internal splines 45.

Slidably mounted in the drive shaft is a mandrel 50 having a matching set of internal splines 51. The mandrel is also of hollow construction having an axial bore 52 which is of stepped diameter extending from the outer end 53 of the mandrel to the inner end 54. At its inner end the mandrel carries a hub 55 of cylindrical shape dimensioned to extend into the recess 32 at the end of the press unit shaft 30. The mandrel is slidable between the retracted position illustrated in FIG. 3 and the extended position illustrated in FIG. 5 in which the hub is in driving engagement with the shaft 30.

In accordance with one of the features of the present invention the hub 55 at the end of the mandrel is of the expandible type, that is, capable, upon actuation, of expanding radially into a tight centered position in the recess 32. As shown in FIG. 3*a*, the hub 55 includes a fixed clamping plate 56 which is supported upon standoff pillars 57 parallel to, and a short distance from, the end 54 of the mandrel. Cooperating with the fixed clamping plate is a movable clamping plate 58 which is supported upon an integral plunger 60 slidably mounted in the bore 52. Interposed between the two clamping plates 56, 58 is a circular resilient clamping element 59. The resilient clamping element is so dimensioned as to be freely accommodated in the recess 32 of shaft 30 as long as no stress is applied to it. However, when the movable clamping element 58 is thrust outwardly by the plunger 60 the clamping element 59 is compressed, expanding outwardly into tight centered engagement with the wall of the recess 32. Reference will shortly be made to the means for applying the clamping force to the plunger 60. It will suffice to say for the present that to facilitate application of such force the plunger is centrally relieved at 61 to provide two reaction forces 62 which are spaced from one another.

Attention will next be given to the means for moving the mandrel between the retracted position illustrated in FIG. 3 and the extended position illustrated in FIG. 5. In accordance with the invention a central plunger, or rod, is telescoped into the mandrel, the outer end of the plunger being anchored with respect to the press frame. A coil spring is interposed between the mandrel and the plunger for biasing the mandrel to a retracted position. The inner end of the plunger is engaged by a manually operated blocking element which acts against the biasing force of the spring thereby to determine the axial position of the mandrel. Thus as shown in FIG. 3 there is, telescoped into the mandrel, a plunger 70 having an outer end 71 which is fixed to an end cap 72 which is secured to the gear 42 by screws 73 or the like. Since the gear is journaled in bearing 44 which is fixed against endwise movement, the plunger 70 is axially fixed with respect to the main frame of the press. Interposed between the mandrel and the plunger is a coil spring 75, the outer end 76 of which is connected to the outer end of the mandrel while its inner end 77 is connected to the plunger. The spring, being stressed in compression, tends to urge the mandrel into its retracted state illustrated in FIG. 3. The axial position of the mandrel is determined by a variable blocking member interposed between the mandrel and the inner end 78 of the plunger, as will now be discussed.

In accordance with one of the important aspects of the present invention a manual operator is provided for engaging the presented ends of the two plungers 70, 60 for shifting the mandrel and for expanding the hub in sequence, so that the hub is first inserted into the recess 32 in the shaft 30 followed by expansion of the hub into tight centered engagement with such recess as shown in FIG. 5. This is accomplished, according to the invention, by a manual operating shaft 80 which is transversely arranged for limited rotational movement in the right-hand end portion of the mandrel. The operating shaft carries a first cam 81 which is of the thin disc type and a two-part cam 82 of the same type but which is differently profiled. For journaling the operating shaft 80 it is fitted into a transverse bore 83. The cam 81 engages the inner end 78 of the plunger 70, while the two portions of the cam 82, which are identical to one another, engage the reaction faces 62 at the presented end of the plunger 60 associated with the expandible hub. The upper end of the operating shaft 80 is provided with a hex socket 84 for engagement by an allen wrench or similar turning tool 85.

The manner in which the sequential movements of the mandrel and the hub are brought about, from the condition illustrated in FIG. 3 to that illustrated in FIG. 5, will now be apparent. Initially the operating shaft 80 is manually turned to the condition corresponding to FIG. 3. In this position the presented end 78 of the plunger 70 occupies a "low" region 81*a* (FIG. 3*b*) on cam 81 so that the mandrel is urged by the spring 75 into its retracted or left-hand position. Also as an initial state, the plunger 60, associated with the hub, occupies a "low" region 82*a* on the cam 82 so that the plunger is released and the resilient clamping element 59 is unstressed and therefore easily fitted into the recess 32 of the shaft 30.

When the operating shaft 80 is manually rotated by the turning tool 85 to an angle of approximately 45 degrees, which is the condition illustrated in FIG. 5*b*, the cam 81 is rotated to present its "high" region 81*b* to the plunger 70, with the reaction force exerted on the cam by the stationary plunger serving to crowd the mandrel to the right to its extended position in which the hub is inserted into the recess. The hub, at this point, remains unstressed.

Upon further rotation of the operating shaft 80 in the clockwise direction, the "high" region 81*b* of the cam 81 remains in contact with the plunger 70 so that the mandrel does not move axially any further. However, the final 45 degrees of motion is sufficient to bring the "high" region 82*b* of the cam 82 against the end faces 62 of the hub plunger 60, causing the clamping element 59 to be compressed so that it expands outwardly into engagement with the wall of the recess 32 of shaft 30, providing tight nearly rigid engagement. When the operating shaft is subsequently rotated in the opposite direction, to restore the condition of FIG. 3*b*, the sequence is reversed, that is, the hub is contracted before it is withdrawn.

In carrying out the invention means are provided for limiting the range of operating movement of the operating shaft 80 thereby to define the two extreme positions of the cam which are illustrated in FIGS. 3*b* and 5*c* and for automatically locking the operating shaft at the ends of its range. The range is defined by a stop 91 recessed in the wall 83 of the transverse bore in the operating shaft and by providing an arcuate groove 92 in the shaft. While a 90 degree throw has been illustrated, it will be understood that the invention is not limited thereto. For locking the operating shaft in its extreme positions of throw, a locking pin 93 is axially arranged within the operating shaft with its head end 94 in the tool socket 84 and biased endwise by a spring 95. At its lower end the locking pin carries a smaller transversely mounted bayonet pin 96 which serves as a detent, engaging angularly spaced notches 97 at the end of the shaft. The bayonet pin is prevented from rotating by engagement of its ends in axially extending grooves 98 formed in the wall of the bore 83.

It will be apparent, then, that when the turning tool 85 is inserted into the socket 84 at the head end of the operating shaft, the head 94 of the pin 93 is pressed downwardly against the force of the spring 95, unseating the bayonet pin 96 from the engaged notch 97, permitting the turning tool to turn the operating shaft to its alternate condition where it is automatically locked by simply withdrawing the tool. This insures that the position of the mandrel and condition of the hub thereon will not depart from the set conditions as a result of vibration or the like.

In accordance with one of the aspects of the present invention the mandrel 50 and press unit shaft 30 are fitted with registering elements which are axially engaged when the mandrel is inwardly extended, thereby to establish a desired phase relationship between them, and register indicia, including indicia on the mandrel and on the press unit shaft, are so positioned that, upon relative rotation to a position of alignment, the registering elements are aligned with one another in readiness for axial engagement. The registering elements are preferably in the form of an axially projecting pin 101 arranged off-center on the mandrel adjacent the projecting hub 55 and which fits snugly into a recess 102 in the form of a hardened pocket in a ring or flange 103 which is rigidly secured to the end of the shaft 30. It will be apparent, then, that the pin 101 is entered into its recess at the same time that the hub is entered into the end of the hollow shaft thereby to insure that the shaft is properly phased.

For the purpose of insuring that the pin 101 and its recess 102 are aligned before they are engaged, registering indicia are provided between the mandrel and the main frame and between the frame and shaft of the press unit. As shown in FIG. 4 such indicia include a pointer 111 on the main frame cooperating with a registering mark 112 on the mandrel as well as a pointer 113 on the frame of the press unit cooperating with an index mark 114 on the ring 103 of the shaft 30. In performing the register step the mandrel is disengaged as shown in FIG. 3 and the ring 103 is manually rotated to bring the indicia 113, 114 into alignment. The press drive is then jogged to bring the indicia 111, 112 into alignment. When this has been accomplished the pin 101 is precisely opposite the recess 102, and thus ready to move into it, when the mandrel is extended.

For the purpose of shifting the press unit shaft broadwise for adjustment of the press unit cylinder 26 an eccentric sleeve 121 is effectively interposed between the main frame member 11 and the bearing 44 which supports the drive shaft which, in turn, supports the mandrel. Such eccentric sleeve is positioned by a worm and worm wheel assembly indicated at 122. To achieve throw-off, a second eccentric sleeve 123 surrounds the sleeve 121 and is connected by an arm 124 to a link 125 operated by the regular press throw-off mechanism 126.

While there is shown, in FIG. 3, only that coupling assembly, with its supporting eccentric sleeves, which exists at one end of the shaft 30, it will be understood that the assembly is duplicated, in mirror image, at the other end of the shaft. Specifically there is at the other end of the shaft 30 a duplicate eccentric sleeve 123 having a linkage 125 connecting it to the press throw-off 126, so that when the press throw-off is operated both ends of the shaft 30 are moved, that is, thrown off, to equal degree. It will be understood, however, that the coupling assembly provided at the opposite end of the shaft 30 may be slightly simplified if desired, for example by omission of the gear wheel 42 on the drive shaft 41 if driving is desired from one side of the press only. A stop 25 may be provided for each sub-frame 21.

Since the amount of "throw" introduced by the eccentrics 121, 123 is quite small, throw-off can be accommodated by providing a resilient annular mount 127 for the bearings 31 at the respective ends of the shaft 30, with cheek members 128 fixed to the frame 21 to permit radial lost motion while precluding play in the axial direction. Where such members are present for radial guidance, the annular element 127 may simply be omitted and the coupling assemblies 40 may be relied upon for support and radial positioning of the press unit shaft.

The auxiliary press unit may, if desired, be employed as a sequential numbering machine. In this usage a control shaft 130 is provided, mounted at its ends in the subframe 21, having means for oscillating the same back and forth for automatic incremental advance of the cipher wheels. Input is provided by a cam follower arm 131 which engages a cam disc 132 on the shaft 30. The rocking movements of the shaft 130 are transmitted to the cipher wheels diagrammatically indicated at 133. Rocking movement may be artificially imparted to the control shaft 130 by means of a manual arm 134, if desired.

It will be apparent that the above-described auxiliary printing unit amply meets the objects set forth above. The unit is compact and completely unitary. By grasping the handles at the upper end of the sub-frames the device may be readily lifted by one person onto the rails 22 and slid into place until the stop 25 is engaged which defines the seated or working position. By utilizing the indicia 111–114 the register pin is aligned with the recess, following which the turning tool 85 is inserted to turn the control shaft of the mandrel, which results in sequential extending movement of the mandrel and expansion of the hub into tight centered driving engagement with the press unit shaft. Note that a single actuator (shaft 80) serves to both shift the mandrel and, sequentially, to clamp it up. For removing the unit the procedure is simply reversed.

Since the coupling assembly is primarily accommodated in the main frame members of the press, the auxiliary press unit may, if desired, occupy substantially the entire space available between the frame members. The clearance space, indicated at 140, between the adjacent frames is only a little more than that required for the registering indicia or for insertion of a turning tool into the socket of the operating shaft of the mandrel.

While it is desired to provide a multiple spline to permit sliding movement of the mandrel within the hollow drive shaft, it will be understood that the term "spline" as used herein is not limited thereto and includes any rotationally keyed axially slidable connection. The term "stop" as applied to stop 25 which determines the operating position of the press unit, shall be understood to mean any locating means for precise positioning of the unit. While the cams 81, 82, although closely coupled, are separated from one another, lying in different planes, the term "cams" as used herein will be understood to refer to cam surfaces, whether or not in different planes. It will also be understood that the resilient clamping element 59, while described as "circular," may consist of separated pads of resilient frictional material spaced in a circular locus.

What I claim is:

1. An auxiliary printing unit and press having provision therefor including, in combination, a press having a press drive and a press main frame formed of a pair of frame members mounting an impression cylinder and providing a seating surface adjacent thereto, an auxiliary press unit having a press unit frame dimensioned to fit on the seating surface between the main frame members with stop means thereon to define a working position, a printing cylinder in the auxiliary press unit having a press unit shaft journaled in the frame thereof, the press unit shaft having a cylindrical recess at its end, a coupling assembly journaled in the press main frame for interconnecting the press drive and the the press unit shaft, the coupling assembly having an internally splined hollow drive shaft coupled to the press drive, the coupling assembly further having an externally splined mandrel slidable endwise in the drive shaft between inwardly extended and retracted positions and having a radially expandible hub at its inner end dimensioned to mate with the recess in the press unit shaft to form a driving connecting therewith when the mandrel is inwardly extended, the mandrel and the press unit shaft having off-center registering elements thereon which are also axially engaged when the mandrel is inwardly extended, register indicia including indicia on the mandrel and on the press unit shaft so positioned that upon relative rotation to a position of alignment the registering elements are aligned with one another in readiness for axial engagement, and manually operated means in the mandrel for sequentially (a) shifting the mandrel from its retracted position to its extended position and (b) expanding the hub to insure a tight centered driving connection with the press unit shaft.

2. The combination as claimed in claim 1 in which the manually operated means is in the form of an operating shaft transversely mounted in the mandrel having respective cams for sequentially shifting the mandrel and expanding the hub thereon.

3. An auxiliary printing unit and press having provision therefor including, in combination, a press having a press drive and press main frame formed of a pair of frame members mounting an impression cylinder and providing a seating surface adjacent thereto, an auxiliary press unit having a press unit frame dimensioned to fit on the seating surface between the main frame members with stop means thereon to define a working position, a printing cylinder in the auxiliary press unit having a press unit shaft journaled in the frame thereof, the press unit shaft having an axial recess at its end, a coupling assembly journaled in the press frame for interconnecting the press drive and the press unit shaft, the coupling assembly having an internally splined hollow drive shaft coupled to the press drive, the coupling assembly further having an externally splined mandrel slidable endwise in the drive shaft and having a hub at its inner end dimensioned to mate with the end of the press unit shaft to form a centered connection therewith when the mandrel is inwardly extended toward the press unit shaft while being axially disengaged therefrom when the mandrel is retracted thereby permitting the auxiliary press unit to be slid transaxially into its working position against the stop means, and manually operated means for shifting the mandrel between its extended and retracted positions.

4. An auxiliary printing unit and press having provision therefor including, in combination, a press having a press drive and press main frame formed of a pair of frame members mounting an impression cylinder and providing a seating surface adjacent thereto, an auxiliary press unit having a press unit frame dimensioned to fit on the seating surface between the main frame members with stop means thereon to define a working position, a printing cylinder in the auxiliary press unit having a press unit shaft journaled in the frame thereof, the press unit shaft having an axial recess at its end, a coupling assembly journaled in the press frame for interconnecting the press drive and the press unit shaft, the coupling assembly having an internally splined hollow drive shaft coupled to the press drive, the coupling assembly further having an externally splined mandrel slidable endwise therein and having a hub at its inner end dimensioned to mate with the end of the press unit shaft to form a centered connection therewith when the mandrel is inwardly extended toward the press unit shaft while being axially disengaged therefrom when the mandrel is retracted thereby permitting the auxiliary press unit to be slid transaxially into its working position against the stop means, the hub at the inner end of the mandrel being dimensioned to telescope into the recess in the press shaft, the hub having means for expanding its radial dimension so as to center the press unit shaft with respect to the mandrel while forming a driving connection with the latter, and manually operated means for sequentially (a) shifting the mandrel from its retracted position to its extended position and (b) radially expanding the hub to form a tight co-axial driving connection.

5. An auxiliary printing unit and press having provision therefor including, in combination, a press having a press drive and press main frame formed of a pair of frame members mounting an impression cylinder and providing a seating surface adjacent thereto, an auxiliary press unit having a press unit frame dimensioned to fit on the seating surface between the main frame members with stop means thereon to define a working position, a printing cylinder in the auxiliary press unit having a press unit shaft journaled in the frame thereof, the press unit shaft being hollow at its end to provide a cylindrical recess, a coupling assembly journaled in the press frame for interconnecting the press drive and the press unit shaft, the coupling assembly having an internally splined hollow drive shaft coupled to the press drive, the coupling assembly further having an externally splined mandrel slidable endwise therein between inwardly extended and retracted positions and having a hub at its inner end dimensioned to telescope into the recess at the end of the press unit shaft to provide a driving connection therewith when the mandrel is inwardly extended while being axially disengaged therefrom when the mandrel is retracted thereby permitting the auxiliary press unit to be slid transaxially into its working position against the stop means, said hub including means for radially expanding the same into engagement with the wall of the recess to insure that the driving connection is tight and centered, means including a first cam for sliding the mandrel from its retracted position to its extended position, means including a second cam for expanding the hub, and manually operated means coupled to the cams for causing them to act in sequence and for subsequently restoring the cams to their initial condition in reversed sequence.

6. The combination as claimed in claim 5 in which the mandrel is of hollow construction having axially telescoped therein first and second plungers, the first plunger being coupled to the frame for relatively shifting the mandrel and the second plunger being coupled to the hub for radially expanding the same, the first and second cams being mounted in the mandrel in alignment with the plungers, the manual operator being in the form of a transverse operating shaft rotatably mounted in the mandrel, the cams being profiled so that the first and second plungers are acted upon in sequence.

7. An auxiliary printing unit and press having provision therefor including, in combination, a press having a press drive and press main frame formed of a pair of frame members mounting an impression cylinder and providing a seating surface adjacent thereto, an auxiliary press unit having a press unit frame dimensioned to fit on the seating surface between the main frame members with stop means thereon to define a working position, a printing cylinder in the auxiliary press unit having a press unit shaft journaled in the frame thereof, the press unit shaft having an axial recess at its end, a coupling assembly journaled in the press frame for interconnecting the press drive and the press unit shaft, the coupling assembly having an internally splined hollow drive shaft coupled to the press drive, the coupling assembly further having an externally splined mandrel slidable endwise in the drive shaft and having its inner end formed to mate with the end of the press shaft to form a driving connection therewith when the mandrel is inwardly extended toward the press unit shaft, a coil spring for biasing the mandrel to a retracted position thereby permitting the auxiliary press unit to be slid transaxially into its working position against the stop means, and means including a manually operated control shaft in the mandrel for shifting the mandrel to its extended position against the restoring force of the spring.

8. The combination as claimed in claim 7 in which the mandrel is of hollow construction, a central plunger telescoped into the mandrel having an inner end and an outer end, the coil spring being interposed between the mandrel and the plunger and interconnecting the same, the outer end of the plunger being anchored with respect to the press frame, a cam on the control shaft, the inner end of the plunger being blockingly engaged by the cam.

9. An auxiliary printing unit and press having provision therefor including, in combination, a press having a press drive and press main frame formed of a pair of frame members mounting an impression cylinder and providing a seating surface adjacent thereto, an auxiliary press unit having a press unit frame dimensioned to fit on the seating surface between the main frame members with stop means thereon to define a working position, a printing cylinder in the auxiliary press unit having a printing unit shaft journaled in the frame thereof, the shaft being hollow to provide a cylindrical recess at its end, a coupling assembly journaled in the press frame for interconnecting the press drive and the press unit shaft, the coupling assembly having an internally splined hollow drive shaft coupled to the press drive, the coupling assembly further having an externally splined mandrel slidable endwise therein between extended and retracted positions and having a cylindrical hub at its inner end dimensioned to mate coaxially with the recess at the end of the press unit shaft, the mandrel also having an off-center register pin for registering with a pin recess on the press unit shaft, first register indicia for relating the press main frame and the mandrel, second register indicia for relating the press unit frame and the press unit shaft so that when the mandrel is in its retracted position alignment of the respective indicia creates a condition of register between the register pin and its recess and so that when the mandrel is subsequently inwardly extended the hub and register pin form a driving connection with the press unit shaft, and manually operated means for shifting the mandrel between its driving and retracted positions.

10. An auxiliary printing unit and press having provision therefor including, in combination, a press having a press drive and a press main frame formed of a pair of frame members mounting an impression cylinder and providing a seating surface adjacent thereto, a pair of rails on the main frame leading to the seating surface, an auxiliary press unit having a press unit frame dimensioned to fit on the seating surface between the main frame members, stop means engaged by the press unit frame to define a working position therefor, a printing cylinder in the auxiliary press unit having a press unit shaft journaled in the frame thereof, the press unit shaft having a cylindrical recess at its end, a coupling assembly journaled in the press main frame for interconnecting the press drive and the press unit shaft, the coupling assembly having an internally splined hollow drive shaft coupled to the press drive, the coupling assembly further having an externally splined mandrel slidable endwise in the drive shaft between inwardly extended and retracted positions and having a radially expandible hub at its inner end dimensioned to mate coaxially with the recess in the press unit shaft to form a driving connection therewith when the mandrel is inwardly extended, the mandrel and the press unit shaft having respective off-center registering elements thereon which are also axially engaged when the mandrel is inwardly extended, first register indicia on the main frame and mandrel alignable by rotationally positioning the mandrel, second register indicia on the press unit frame and the press unit shaft so related that upon rotation thereof to a position of alignment the registering elements are aligned with one another in readiness for axial engagement, and manually operated means for sequentially (a) shifting the mandrel from its retracted position to its extended position and (b) expanding the hub to insure a tight centered driving connection with the press unit shaft.

11. The combination as claimed in claim 1 or claim 3 or claim 4 or claim 5 in which an eccentric sleeve is interposed between the main frame and the hollow drive shaft, the mandrel and the press unit shaft being coaxially coupled together with sufficient rigidity when the mandrel is extended that rocking of the eccentric produces transaxial shifting of the press unit shaft.

12. The combination as claimed in claim 1 or claim 3 or claim 4 or claim 5 in which the structure of the coupling assembly is substantially duplicated in mirror image at the opposite end of the press unit shaft, eccentric sleeves being interposed between the hollow drive shafts and the respective main frame members, and means for rocking the sleeves in unison to produce equalized transaxial shifting at the respective ends of the press unit shaft.

13. The combination as claimed in claim 1 or claim 3 or claim 4 or claim 5 in which the manually operated means includes a shaft having stops defining the range of operating movement with releasable means for automatically locking the shaft at the ends of its range.

14. The combination as claimed in claim 1 or claim 3 or claim 4 or claim 5 in which the structure of the coupling assembly is substantially duplicated in mirror image at the opposite end of the press unit shaft, eccentric sleeves interposed between the hollow drive shafts and the respective main frame members, means for rocking the sleeves in unison to produce equalized transaxial shifting at the respective ends of the press unit shaft, the press unit shaft having its ends journaled in bearings in the press unit frame, the bearings being restricted against endwise movement but having a limited amount of lost motion whereby limited transaxial movement may be imparted to the press unit shaft for positioning the same by simultaneous rocking of the eccentric sleeves.

* * * * *